United States Patent [19]

Palemon Camu

[11] 4,297,757

[45] Nov. 3, 1981

[54] MARINE RESCUE CAPSULE

[76] Inventor: Oscar M. Palemón Camú, 40-C Estocolmo St., Mexico City 6, Mexico

[21] Appl. No.: 930,607

[22] Filed: Aug. 3, 1978

[51] Int. Cl.[3] ..... B63C 9/02

[52] U.S. Cl. ..... 9/4 R; 9/4 A; 9/11 R; 9/1.5; 9/14; 114/138; 114/141; 114/201 R; 114/178; 114/211

[58] Field of Search ..... 98/119; 9/4 R, 4 A, 9/8 R, 11 R, 11 A, 14, 1.5; 114/127, 138, 139, 140, 141, 124, 126, 211, 212, 173–178, 201 R–203

[56] References Cited

U.S. PATENT DOCUMENTS

| | | | |
|---|---|---|---|
| 196,874 | 11/1877 | Casey | 9/4 R |
| 494,090 | 3/1893 | Stevens | 9/4 A |
| 835,498 | 11/1906 | Brude | 9/4 R |
| 1,181,009 | 4/1916 | Hoy | 9/4 R |
| 1,276,826 | 8/1918 | Taira | 9/4 R |
| 2,129,742 | 9/1938 | Mason | 9/4 A |
| 2,551,750 | 5/1951 | Liskey | 114/201 A |
| 3,060,465 | 10/1962 | Carstensen | 9/14 |
| 3,110,281 | 11/1963 | Buck | 114/141 |
| 3,502,047 | 3/1970 | Crosbie | 114/212 |
| 3,883,913 | 5/1975 | Givens | 9/2 A |

*Primary Examiner*—Trygve M. Blix
*Assistant Examiner*—D. W. Keen
*Attorney, Agent, or Firm*—Weiser, Stapler & Spivak

[57] ABSTRACT

A marine capsule for sea rescue and transportation having a generally spherical configuration and on its sides hermetically closed hatches of tempered glass and a sun-reflecting signal-sending film. At its top are four larger diameter hatches, two of which preferably permit access of persons or equipment into the capsule. Also there may be waterproof lateral access windows or openings for persons without seafaring experience. The other two overhead hatches have a ventilation system, which admits air but not water. A stowable stabilizing element has members which can be telescoped by a gear and crank system so as not to interfere with handling of the capsule when not in use, but to extend when it is afloat. Radial fins ending in a peripheral fin protrude from the lower outside of the capsule, and an air chamber is built into its body. Other interior equipment includes a seat extending all around, storage compartments, water and toilet.

12 Claims, 13 Drawing Figures

FIG. 6
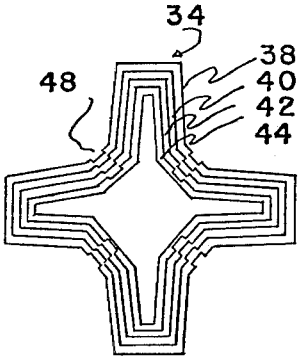
FIG. 7
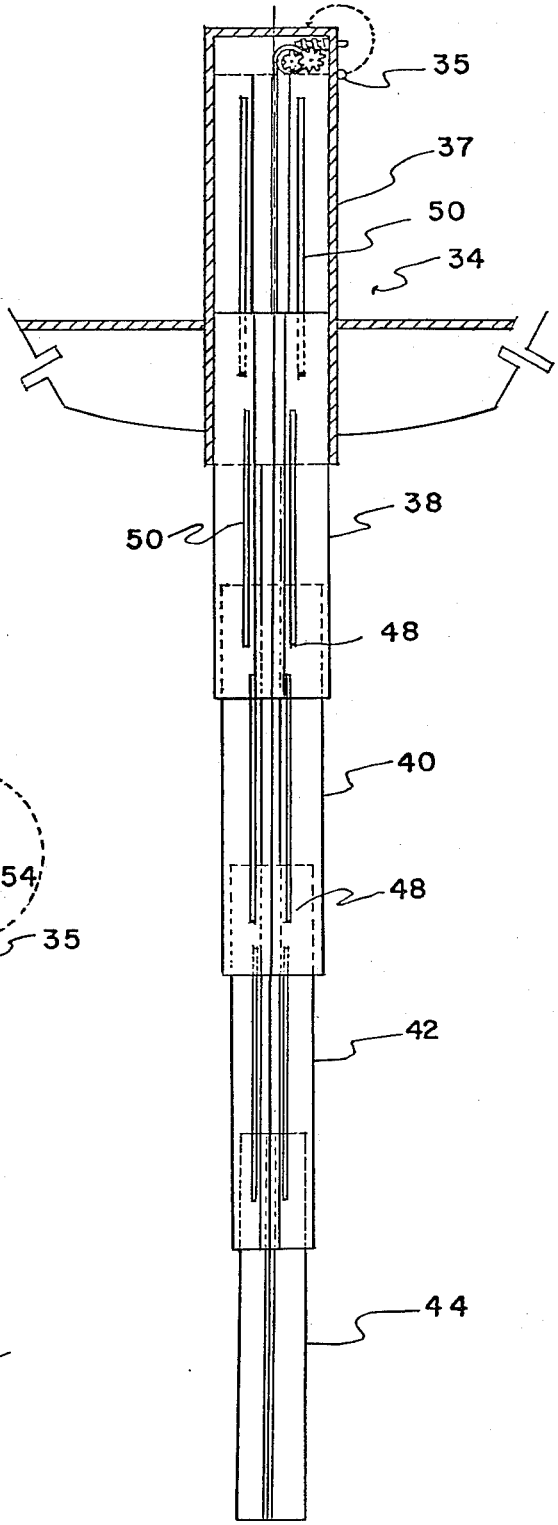
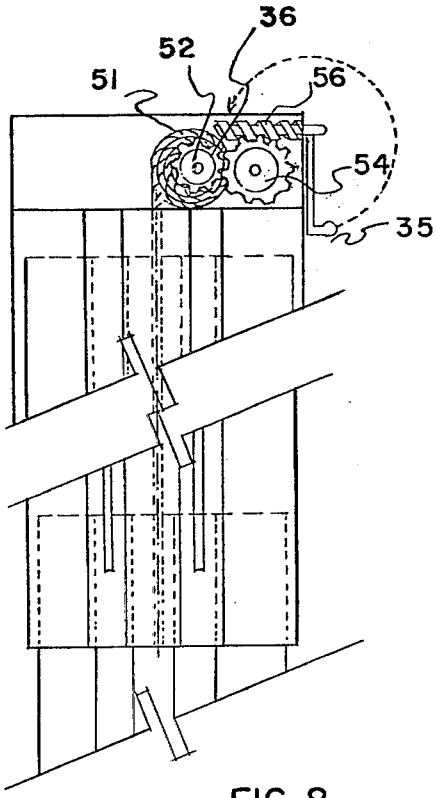
FIG. 8

MARINE RESCUE CAPSULE

BACKGROUND OF THE INVENTION

As has been mentioned above, the problem has always existed of constructing an adequate means for lifesaving of persons at sea in case of shipwreck. Up to the present time the usual means of rescue consists of boats or rafts of various sizes and designs; these all have the problem of their stability in high seas and hence of the safety of their occupants, whose chances of rescue are considerably reduced in rough weather, in addition to the discomforts entailed in the use of such lifesaving equipment, for their occupants are exposed to the atmosphere and the elements, as well as to the lack of adequate provisions for subsistence, for when disaster strikes no one provides such rafts with the minimum requirements for survival.

OBJECTS OF THE INVENTION

Accordingly it is a principal object of this invention to provide a device for lifesaving at sea, having an optimum safety factor under whatever conditions may prevail at sea.

Another object of the invention is the design and construction of a device for lifesaving at sea, which is suitable to be carried by ships, and is provided with the necessary elements for survival of its occupants during long periods afloat.

Still another object of the present invention is the construction of a seagoing lifesaving capsule provided with waterproof means of access as well as of means of ventilation assuring the supply of air to its interior.

Yet another object of the invention is the construction and design of a marine lifesaving capsule which provides inside compartments for storage under sanitary conditions of foods, water, navigational equipment, a toilet, etc., to assure the survival of its occupants during extended periods afloat.

A further object of the present invention is the construction of a marine lifesaving capsule provided with external stabilizing elements permitting the floating of said capsule under severe conditions at sea.

These and other objects are fully accomplished as will be clear in the detailed description which is given below based on the embodiments of the invention which are illustrate; this description is based on the accompanying drawings, in which

BRIEF DESCRIPTION OF THE DRAWINGS

FIG. 6 is a plan view of the stabilizing element;

FIG. 7 is a vertical elevation in partial section of the stabilizing element;

FIG. 8 is a view in cross-sectional elevation of the actuating mechanism for the stabilizing element;

DETAILED DESCRIPTION OF THE INVENTION

Figure 1:
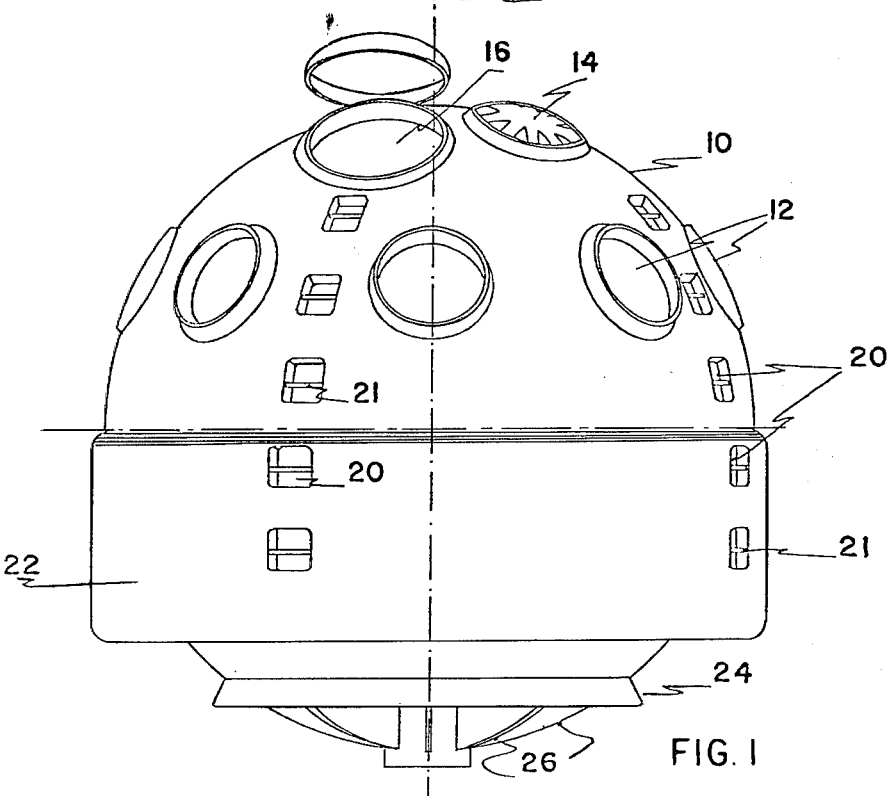
FIG. 1 is a view in vertical elevation of the outside of the capsule of the present application in accordance with a first embodiment thereof.
Figure 4:
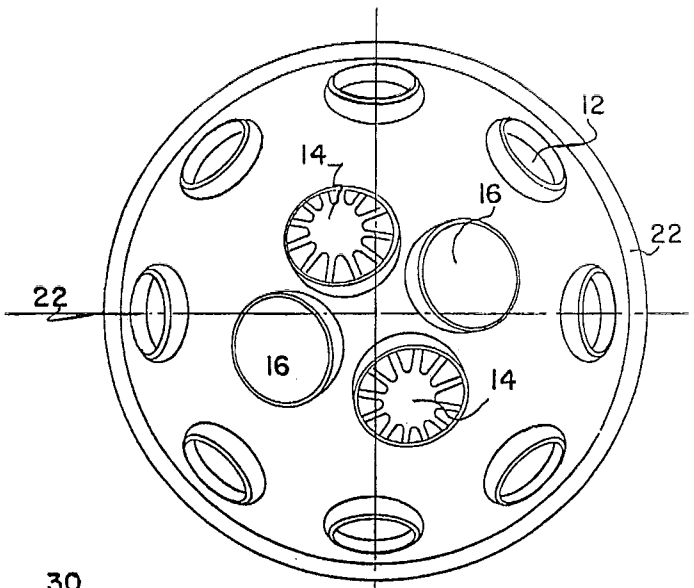
FIG. 4 is a plan view of the capsule.

The marine lifesaving capsule, which is identifies in FIG. 1 with reference 10, takes a generally spherical configuration, and is built of fiberglas suitably reinforced although it is of course also contemplated to build it of any other suitable material, such as molded or extruded plastic materials, always providing that they afford suitable physical properties to assure the strenght of the capsule. The said capsule provides a series of observation portholes 12 located approximately in the upper third of the body of the capsule, which are hermetically sealed against water by a double layer of tempered glass provided with a reflecting film which impedes the penetration of solar rays into the inside of the capsule 10 and which also serve for emitting luminous guiding signals for their rescue on the high seas.

At the extreme top there are provided four hatches 14 and 16 of larger diameter than portholes 12, two of which function as openings for access of persons and equipment required in the capsule, as well as means permitting the ventilation thereof when conditions of the sea permit. In hatches 14 there are provided, for each, ventilation systems, of which a detailed description will be given below relating to FIGS. 9 and 10, the purpose of which is to supply the necessary air to the interior of the capsule when for some reason hatches 16 cannot be used as breathing openings, as may be the case when the sea is rough and opening hatches 16 might cause the entry of water into the capsule.

As can be appreciate in FIGS. 1, 2 and 3 of the accompanying drawings, capsule 10 is provided with means to guarantee its flotation, as has been illustrated with reference number 22, which indicates a surrounding exterior compartment which is waterproof, forming an air chamber and permitting of keeping capsule 10 afloat even in the extreme case in which its inside were partially or even completely flooded.

At the lower outside portion of the body of the capsule eight radial fins 26 are placed which are limited longitudinally by a peripheral rib 24, contributing to the stability of capsule 10 in the open sea.

Also on the outer surface of the capsule there are provided four series of hollows or depressions 20 transversely disposed within which are bars 21 which serve as ladder rungs for access to the capsule.

Capsule 10 carries on its underside and within it a telescoping stabilizing counterweight which is operated from within the capsule by means of a set of gears 36 actuated by a crank 35; this counterweight element will be described in greater detail in connection with FIGS. 6, 7 and 8, since it constitutes along with the system of ventilation an essential aspect of the invention.

Figure 2:
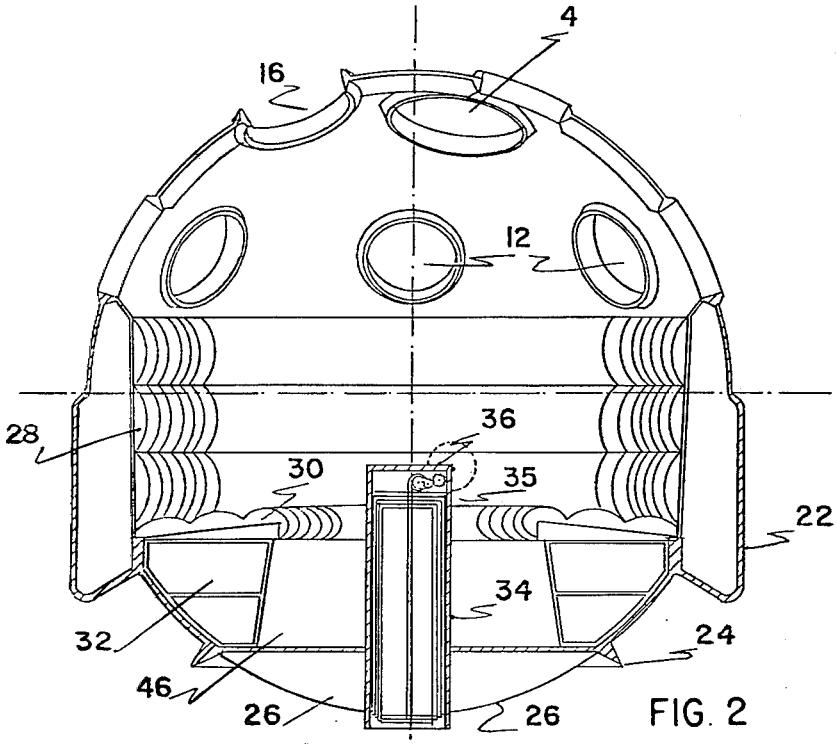
FIG. 2 is a view in vertical cross-section of the capsule, with its stabilizing element retractes.
Figure 3:
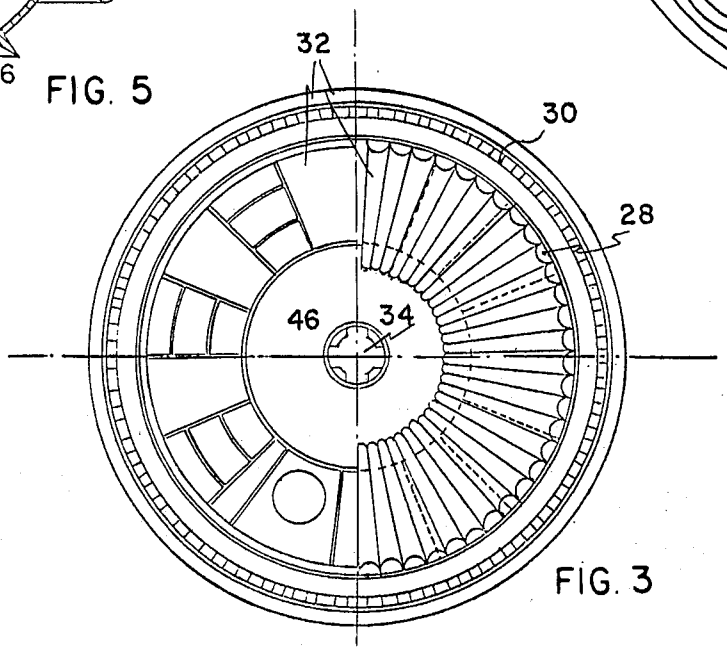
FIG. 3 is a view in vertical cross-section of the capsuple with its stabilizing element extended.
Figure 5:
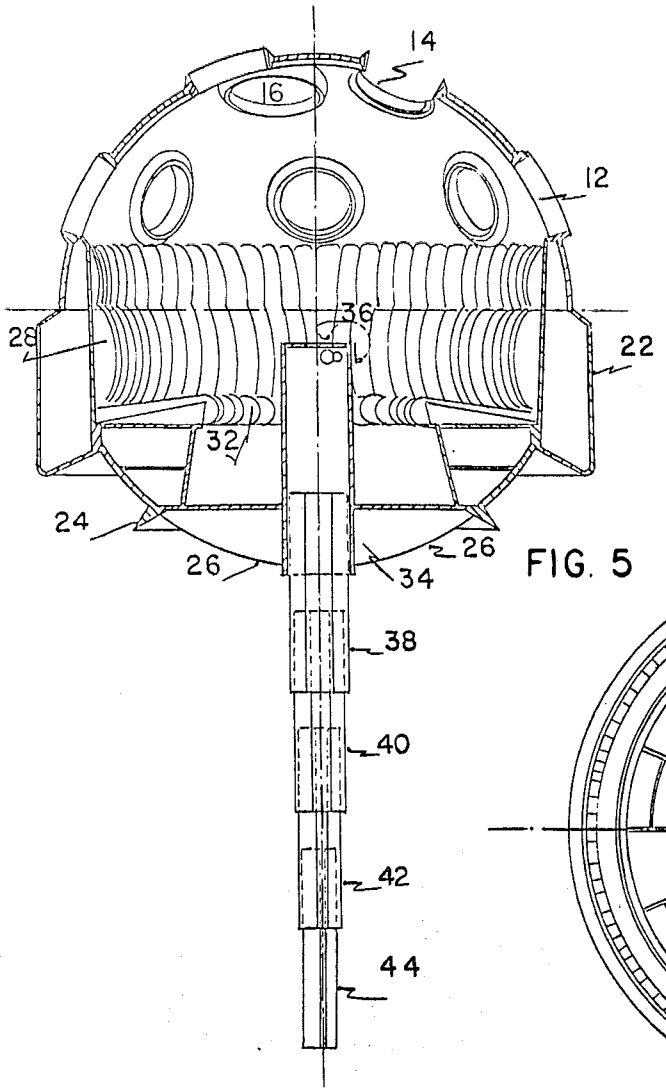
FIG. 5 is a view in horizontal cross-section of the capsule.

As is evident in FIGS. 2, 3 and 5 of the accompanying drawings, the interior of capsule 10 provides seal 32 provided with seat back 28, which establishes a free area 46 between the body of seat 30 and stabilizing counterweight 34, thus permitting of carrying in comfort at least eight travelers in its interior, in either a sitting or standing position. In the portion below seat 30 there are provided various compartments 32 in which dehydrated provisions are stored, potable water and assorted equipment, as well as a toilet of suitable dimensions, in accordance with the capacity of the space available in the capsule, with chemical substances to prevent bad odors as well as to disintegrate solid substances deposited therein, all of which contribute to assure the survival of its occupants during long periods of time at sea.

With regard to the stabilizing counterweight 34, which is illustrated in detail in FIGS. 6,7 and 8 of the accompanying drawing, it consists of a cover or housing 37 within which are accomodated various bodies 38, 40,42 and 44 of the telescoping stabilizing counterweight 34. As is indicated in the drawings just mentioned, the stabilizing counterweight 34 possesses three hollow bodies 38,40 and 42 of different volume, with the object of nesting all the elements of which it is composed in the retracted position. They are of such length as permits extending the last element 44 of the series to a sufficient depth in the water to make it practically impossible for the capsule to be overturned by the effect of the waves of the sea and in the event of being capsized to make it return to its original position. The foregoing will be clearer if it is borne in mind that body 44 of the said counterbalancing stabilizer is made of a heavy material, such as steel, to the weight of which is added the weight of each of the telescoping elements 38,40 and 42, thus assuring the stability of the lifesaving capsule of the present invention. It must be understood that the said telescoping stabilizing counterweight is watertight.

Stabilizing counterbalance 34 is telescoping because of slots 50 and pins 48 of its various component elements, and is able to be protracted or extended by means of cable 51, which at one of its ends is secured to solid counterweight 44 and passes through the hollow central portion of each one of elements 38, 40 and 42 up to reel 52 which carries cable 51 when the stabilizing counterweight 34 is in retracted position.

Reel 52 has at one of its ends gear 52 which in combination with gear 54, worm gear 56 and crank 35 permits of drawing in and holding in its retracted position stabilizing counterweight 34.

Figure 9:
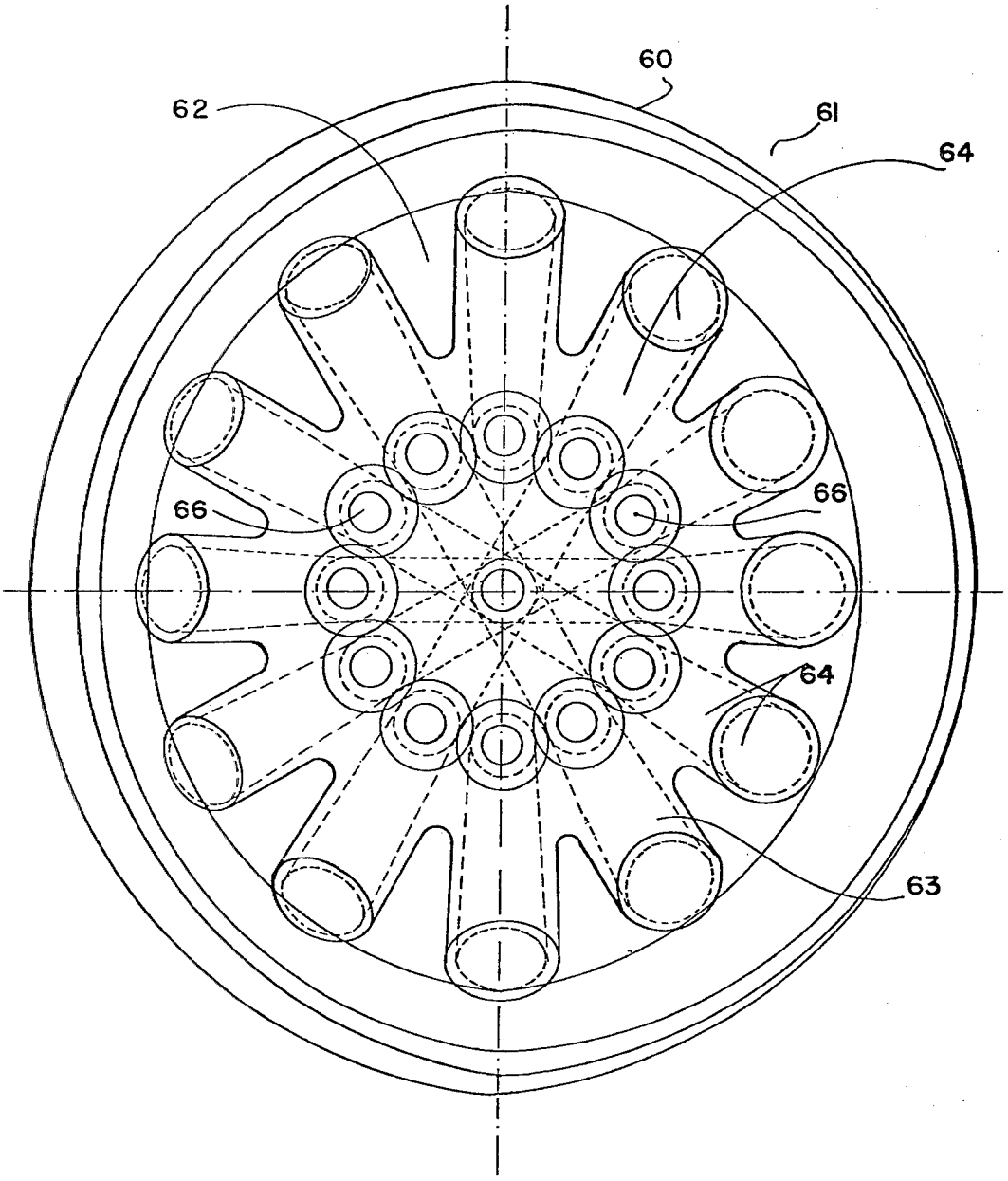
FIG. 9 is a plan view of the system of ventilation of the capsule in accordance with one embodiment of the invention.
Figure 10:
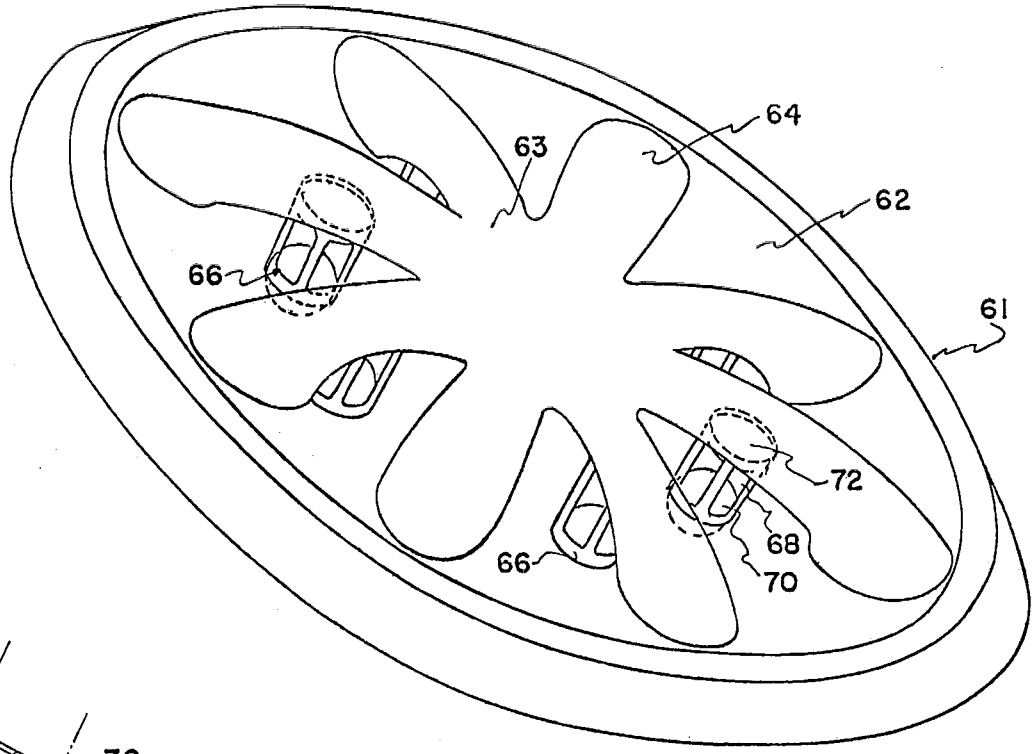
FIG. 10 is a perspective view of the breathing system in accordance with one specific embodiment of the invention.

FIG. 9 illustrates in plan view one of the embodiments of the system of ventilation 61, designed to be mounted in a water-tight manner on one of the upper hatches 14 of capsule 10, which is composed of an outer ring 60 and a concave mounting wall 62 which carries on its upper surface a ventilation spider 63 having a plurality of hollow arms 64 the end portions of which communicate through a perforation 74 to the inside of the capsule 10. Each one of the lengths or projections 64 of the ventilation spider 63 carries a tubular projection 66 which projects downward, as can be more clearly appreciated in FIGS. 10 and 11, with ventilation ports 68, and in which a small sphere 70 is carried, which as is shown in FIG. 10 rests upon concave wall 62, thus permitting the entry of air through ports 68 which circulates to the interior of spider 63 through perforations 72 and from there passes to the inside of the capsule through apertures 74.

Figure 11:
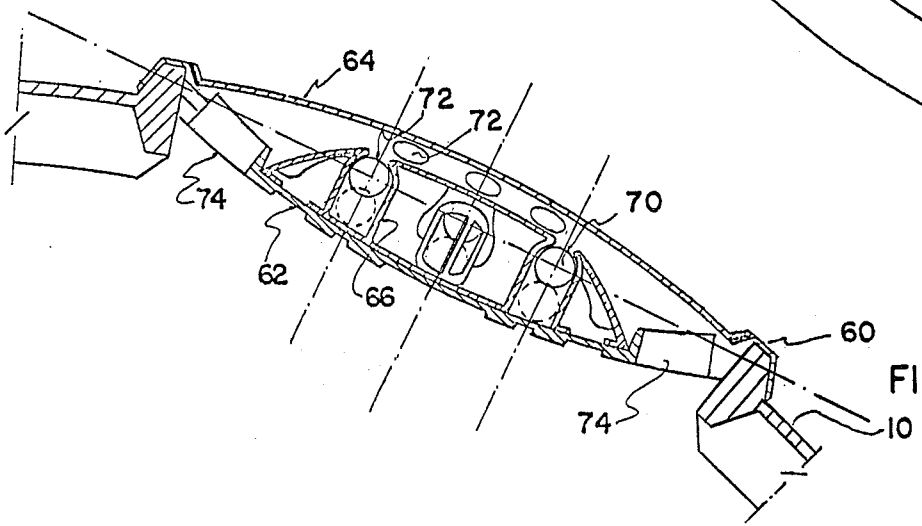
FIG. 11 is a view in vertical cross-section of the breathing system of FIG. 10.

When for any reason the capsule is covered with water, small spheres 70 will tend to rise and obstruct apertures 72, thus preventing the water from penetrating toward the body of the ventilation spider 63 and thence to the interior of the capsule, which situation is illustrated in FIG. 11. Once the capsule is afloat, or at least hatches 14 are above water, spheres 70 fall by gravity to the position illustrated in FIG. 10 permitting the entry of air into the capsule. It should be understood that the number of legs of the ventilation spider 63 is variable depending on the air requirements within the capsule.

Figure 13:
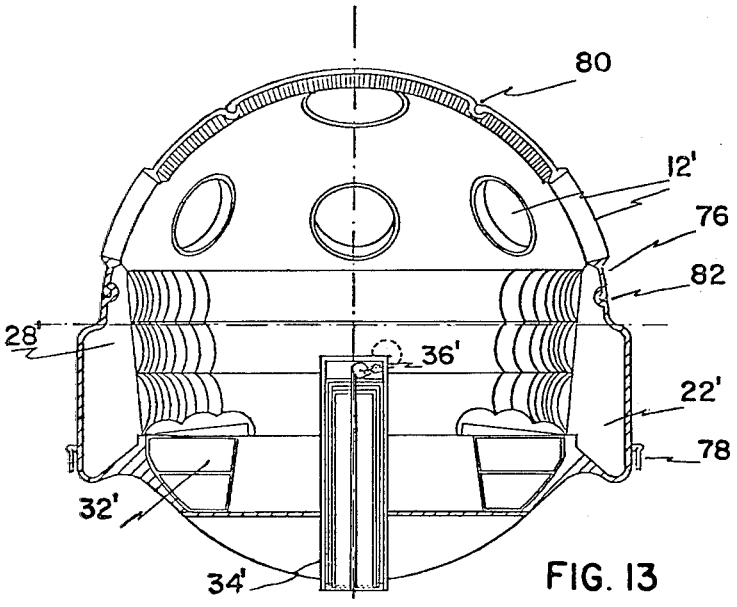
FIG. 13 is a view in vertical cross-section of the capsule of FIG. 12, with its access hatches in the closed position.
Figure 12:
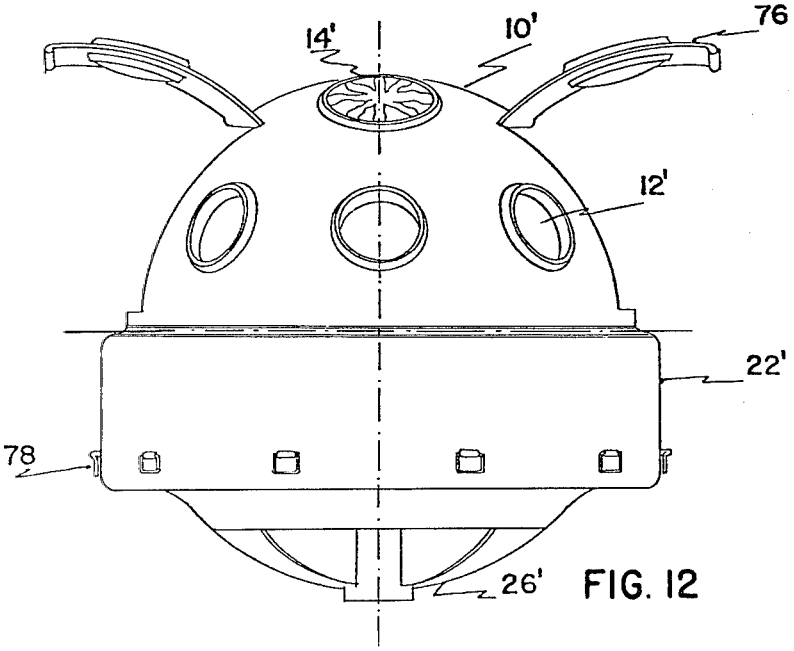
FIG. 12 is a view in lateral elevation of the capsule in accordance with an additional embodiment of the invention.

As has been mentioned above, the lifesaving marine capsule can be designed according to a wide range of considerations, and while in the drawings herein taken as the basis for the description of the invention reference has been made to a capsule having upper hatches for the access of persons and equipment, it is within the spirit of the present invention to make certain modifications permitting greater versatility and comfort for access to the inside of the capsule, as is evident from the embodiment illustrated in FIGS. 12 and 13 accompanying the present work, in which the same reference number is used for units equivalent to those illustrated in the preceding drawings, except that they are now keyed reference numbers.

Capsule 10 in FIGS. 12 and 13 shows two access doors 76 diametrically opposite each other, hinged at their upper side 80, which close watertight. On the outside of the capsule on the lower part of air chamber 22 rings 78 are provided for various uses, particularly for launching by means of a crane, which elements can be included in the capsule of FIG. 1, or other suitable means for handling, transportation and hoisting of the capsule aboard ships provided with this type of lifesaving equipment.

From the foregoing description it can be concluded that the marine lifesaving capsule which is the object of the present application provides structural characteristics which make it exceptionally reliable under any circumstance, which characteristics are in sum the following: it has balanced stabilization in any position level, which assures flotation of the capsule even in those cases in which the body may be ruptured. Its system of ventilation assures a supply of air to its interior, obstructing the entry of water. Its spherical configuration presents no resistence to the movement of the water, and at the same produces uniform distribution of stress, obviating weak points, which problem affects lifesaving craft of the present state of the art. Its radial bottom fins and its pheripheral fin contribute to grater stability of the capsule, adding to the stabiity afforded by the vertical stabilizer which establishes a point of gravity assuring its return to correct vertical position when a wave may cause it momentarily to take a different position.

Thus it is evident that all of the objectives announced have been fully satisfied and others not cited as well; and while persons versed in the subject matter may conceive changes and modifications in what has been described in relation to the specific embodiments of the invention, the description is to be understood as broadly indicative but not restrictive, since the scope of this invention is defined by the following claims.

What is claimed is:

1. A marine lifesaving capsule of substantially spherical configuration carrying on the upper third of its body portholes which are watertight but allow the penetration of solar light; having doors or hatches for access disposed either on the top or the sides of its body; a series of radial fins on the bottom limited by a peripheral fin for stabilizing the capsule; an air chamber surrounding it the upper edge of which coincides substantially with the flotation line of the capsule; a telescoping stabilizing counterweight having its axis coinciding with the vertical axis of the capsule; a system of ventilation provided in at least two upper hatches of the capsule; and a ring-shaped seat under which several compartments are set off for storage of dehydrated provisions, including water, navigational equipment, toilet; said system of ventilation consisting of a hollow body provided with radial projections communicating with the interior of the body of the capsule by means of apertures, the said radial projections having cylindrical passages open to the atmosphere directed downward to each of the radial projections and partially obstructed by spherical bodies which floatingly slide along the said cylindrical passages, permitting free passage of air into the said hollow body and obstructing the passage of water thereinto.

2. A marine lifesaving capsule as set forth in claim 1, in which the said system of ventilation is fixedly mounted on one of the upper hatches of the capsule.

3. A marine lifesaving capsule as set forth in claim 1, in which the access hatches are placed on the upper part of the capsule, permitting under conditions of a calm sea the ventilation of the inside of the capsule.

4. A marine lifesaving capsule us set forth in claims 1, in which the access doors are placed on the side of the capsule and their closure is watertight.

5. A marine lifesaving capsule as set forth in claim 1, in which the said air chamber is an integral part of the body of the capsule, the upper edge of which coinciding substantially with the flotation line, allowing the capsule to float even if it were entirely flooded through rupture of its walls.

6. A marine lifesaving capsule as set forth in claim 1, in which the telescoping stabilizing counterweight is composed of at least three hollow members of different cross-sectional area permitting the telescoping nesting of the same and an end component of heavy material in order to establish a point of gravity which can assure the suitable vertical position of the capsule under any condition of flotation.

7. A marine lifesaving capsule as set forth in claims 1 or 6 in which the said telescopic stabilizing counterweight is lowered or extended by means of a combination of gears and crank with the assistance of a cable secured to the bottommost piece of the said counterweight, guiding its extension by means of slots formed longitudinally in the component pieces thereof, in combination with pins which extend through the slots and constitute limiting stops for its maximum protraction.

8. A marine lifesaving capsule as set forth in claim 7, in which the said telescoping pieces of the stabilizing counterweight are accommodated in their retracted position within a housing which projects partially into the interior of the capsule.

9. A marine lifesaving capsule of substantially spherical configuration having at least two hatches disposed generally on the top of its body; and a system of ventilation provided in at least said two hatches, said system of ventilation consisting of a hollow body provided with radial projections communicating with the interior of the body of the capsule by means of apertures; the said radial projections having cylindrical passages open to the atmosphere directed downward to each of the radial projections and partially obstructed by spherical bodies which floatingly slide along the said cylindrical passages, permitting free passage of air into the said hollow body and obstructing the passage of water thereinto.

10. A marine lifesaving capsule of substantially spherical configuration carrying on the upper third of its body portholes which are watertight but allow the penetration of solar light; having doors or hatches for access disposed either on the top or the sides of its body; a series of radial fins on the bottom limited by a peripheral fin for stabilizing the capsule; an air chamber surrounding it the upper edge of which coincides substantially with the flotation line of the capsule; a telescoping stabilizing counterweight having its axis coinciding with the vertical axis of the capsule; a system of ventilation provided in at least two upper hatches of the capsule; and a ring-shaped seat under which several compartments are set off for storage of dehydrated provisions, water, navigational equipment, toilet, etc., the said portholes arranged on the upper third of the capsule being hermetically sealed against water by means of glass provided with a reflecting surface impeding the direct passage of solar rays and also serving to emit signals.

11. The capsule of claim 10 wherein the glass is tempered double-layered glass.

12. A marine livesaving capsule of substantially spherical configuration carrying on the upper third of its body portholes which are watertight but allow the penetration of solar light; having doors or hatches for access disposed either on the top or the sides of its body; a series of radial fins on the bottom limited by a peripheral fin for stabilizing the capsule; an air chamber surrounding it the upper edge of which coincides substantially with the flotation line of the capsule; a telescoping stabilizing counterweight having its axis coinciding with the vertical axis of the capsule; a system of ventilation provided in at least two upper hatches of the capsule; and a ring-shaped seat under which several compartments are set off for storage of dehydrated provisions, water, navigational equipment, toilet, etc., the said system of ventilation being fixedly mounted on one of the upper hatches of the capsule.

* * * * *